US008908900B2

(12) United States Patent
Mearig et al.

(10) Patent No.: US 8,908,900 B2
(45) Date of Patent: Dec. 9, 2014

(54) SUSPENDED AUDIO PERFORMANCE SYSTEM

(75) Inventors: Brock Mearig, Ephrata, PA (US); Adam Davis, Leola, PA (US); Tyler Kicera, Manheim, PA (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 246 days.

(21) Appl. No.: 13/441,348

(22) Filed: Apr. 6, 2012

(65) Prior Publication Data

US 2013/0266172 A1 Oct. 10, 2013

(51) Int. Cl.
*H04R 1/02* (2006.01)

(52) U.S. Cl.
USPC ..... 381/387; 381/386; 248/317

(58) Field of Classification Search
USPC ..... 381/387, 388, 182, 386
See application file for complete search history.

(56) References Cited

U.S. PATENT DOCUMENTS

2007/0228241 A1* 10/2007 Engebretson et al. ..... 248/317
2008/0137893 A1* 6/2008 Ross et al. ..... 381/332
2008/0170735 A1* 7/2008 Engebretson et al. ..... 381/335

* cited by examiner

*Primary Examiner* — Duc Nguyen
*Assistant Examiner* — Phan Le

(57) ABSTRACT

A suspended audio performance system including a first electroacoustic device and a first base structure secured to the first electroacoustic device. The first base structure is configured to be suspended between a first suspended position and a second suspended position. The first base structure includes an orientation adjustment device for controllably adjusting an angular orientation of the first electroacoustic device

15 Claims, 7 Drawing Sheets

SUSPENDED AUDIO PERFORMANCE SYSTEM

FIELD

The disclosure is generally related to an audio performance system typically associated with a public performance. More particularly, the disclosure includes an audio performance system that is suspended during a public performance.

BACKGROUND

When presenting events such as concerts or theatre productions, winches, pulleys and other equipment are commonly used for support, movement and manipulation of performers and various equipment, such as, lighting, sound, scenery and props. Such equipment, including sound equipment associated with concerts are often transported to each performance venue, requiring specialized, manual set-up or installation, as well as manual disassembly. In addition, to provide improved audio performance, installation of such sound equipment may be suspended above the audience. Unfortunately, the orientation of the sound equipment of current construction must be set prior to raising the sound equipment, without knowing the orientation that would provide optimum performance. Therefore, any desired orientation adjustment of the sound equipment requires the sound equipment to be lowered, possibly multiple times, which is time consuming. There currently remains a need in the performance industry to provide an audio performance system that permits orientation adjustment of the sound equipment while the sound equipment remains suspended at the desired position for the performance.

What is needed is a method and apparatus that addresses the above-referenced issues and concerns. The present device addresses the issues listed above.

SUMMARY

In an exemplary embodiment, a suspended audio performance system includes a first electroacoustic device and a first base structure secured to the first electroacoustic device. The first base structure is configured to be suspended between a first suspended position and a second suspended position. The first base structure includes an orientation adjustment device for controllably adjusting an angular orientation of the first electroacoustic device.

In a further exemplary embodiment, a suspended audio performance system includes a first electroacoustic device, a second electroacoustic device and a first base structure pivotably secured to the first electroacoustic device. The first base structure is configured to be suspended between a first suspended position and a second suspended position. The first base structure includes an orientation adjustment device for controllably adjusting an angular orientation of the first electroacoustic device. A second base structure is pivotably secured to the second electroacoustic device. The second base structure is configured to be secured to the first electroacoustic device. The second base structure is configured to be suspended beneath the first electroacoustic device between the first suspended position and the second suspended position. The second base structure includes an orientation adjustment device for controllably adjusting an angular orientation of the second electroacoustic device.

In a yet further exemplary embodiment, a method for angular orientation control of a suspended audio performance system including providing a first electroacoustic device and a first base structure pivotably secured to the first electroacoustic device. The first base structure is configured to be suspended between a first suspended position and a second suspended position. The method further includes controllably adjusting an angular orientation of the first electroacoustic device between the first suspended position and the second suspended position.

Further aspects of the method and system are disclosed herein. The features as discussed above, as well as other features and advantages of the present disclosure will be appreciated and understood by those skilled in the art from the following detailed description and drawings.

DETAILED DESCRIPTION

Provided is an audio performance system that can be easily and rapidly converted from a transport configuration of a shipping container containing electroacoustic devices to a suspended configuration in which the orientation of the electroacoustic devices may be controllably adjusted after the electroacoustic devices have been suspended. The audio performance system may be used as part of a performance, typically, but not necessarily attended by the public. Such a performance or event may occur as part of a performance of a professional entertainer, speaker, sporting event or other occasion. However, for purposes of the disclosure, any purpose or event associated with an audio transmission is contemplated, and the term performance or event may be used interchangeably.

Figure 1:
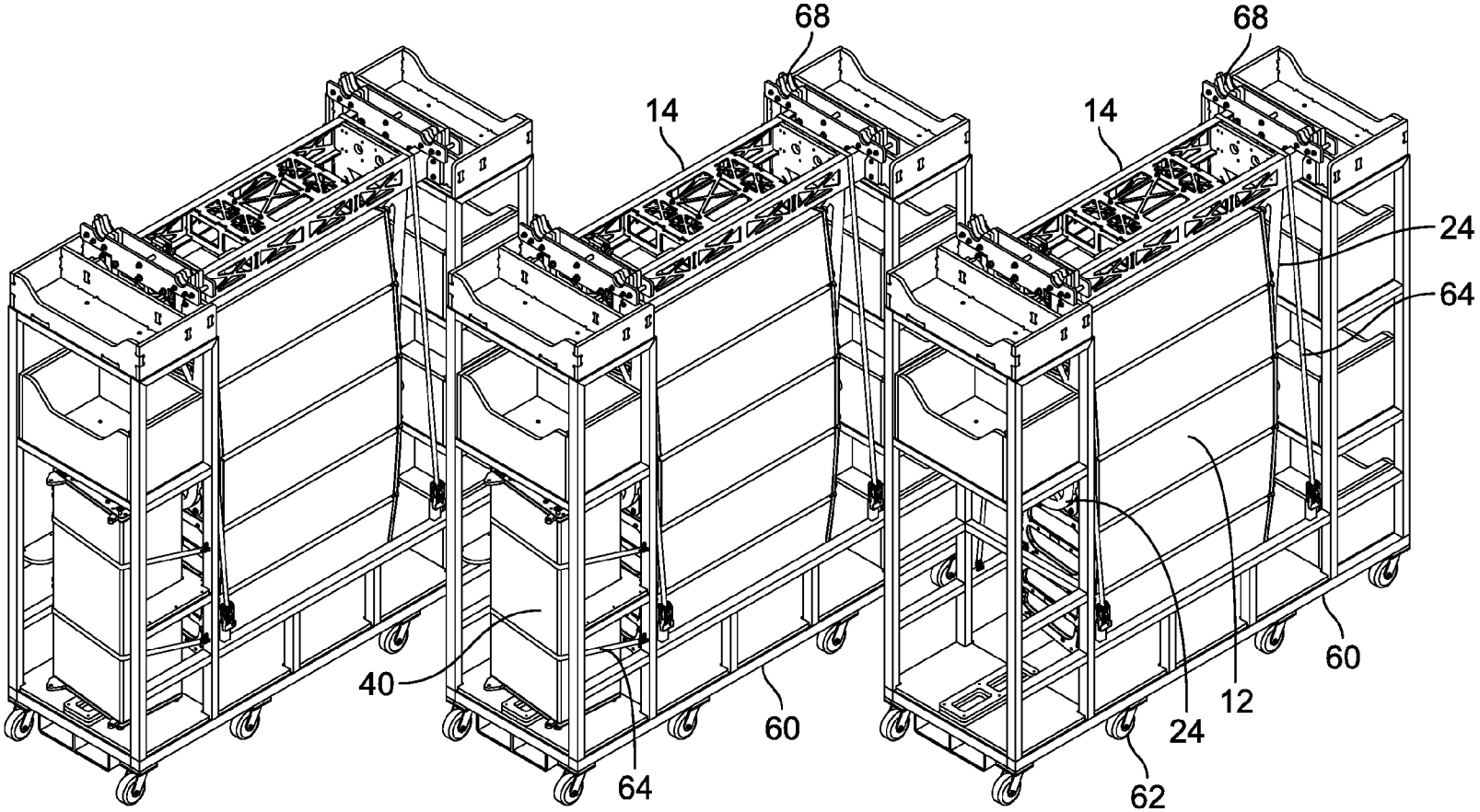
FIG. 1 shows a perspective view of shipping containers of an audio performance system configured for transport according to an exemplary embodiment of the disclosure.

FIG. 1 shows a perspective view of an audio performance system 10 including at least one shipping container 60 having casters 62 for portability. In one embodiment, shipping containers 60 are sized to be portable by commercial air, land or sea transportation apparatus. Shipping container 60 includes a first electroacoustic device 12, such as an audio speaker that is secured in shipping container 60 in a transport mode, such as by straps 64. Shipping container 60 may also include a second electroacoustic device 40 similarly secured in shipping container 60 by straps 64. As shown in the figures, first electroacoustic device 12 shows a plurality, also referred to as an array of electroacoustic devices that may be arranged to deliver optimum audio performance for an event. For purposes of the disclosure, the term electroacoustic device may refer to one or more electroacoustic device(s). As further shown in FIG. 1, first electroacoustic device 12 is pivotably secured to a first base structure 14 that is securely supported in shipping container 60. As further shown in FIG. 4, first base structure 14 includes a first yoke 24 that is secured at one end to first base structure 14 and at the other end to first yoke 24, which pivotably secures first electroacoustic device 12 about a first axis 26. In transport mode, first electroacoustic device 12 is secured beneath first base structure 14 and oriented generally perpendicular to first base structure 14 in order to fit within the envelope of shipping container 60.

Figure 2:
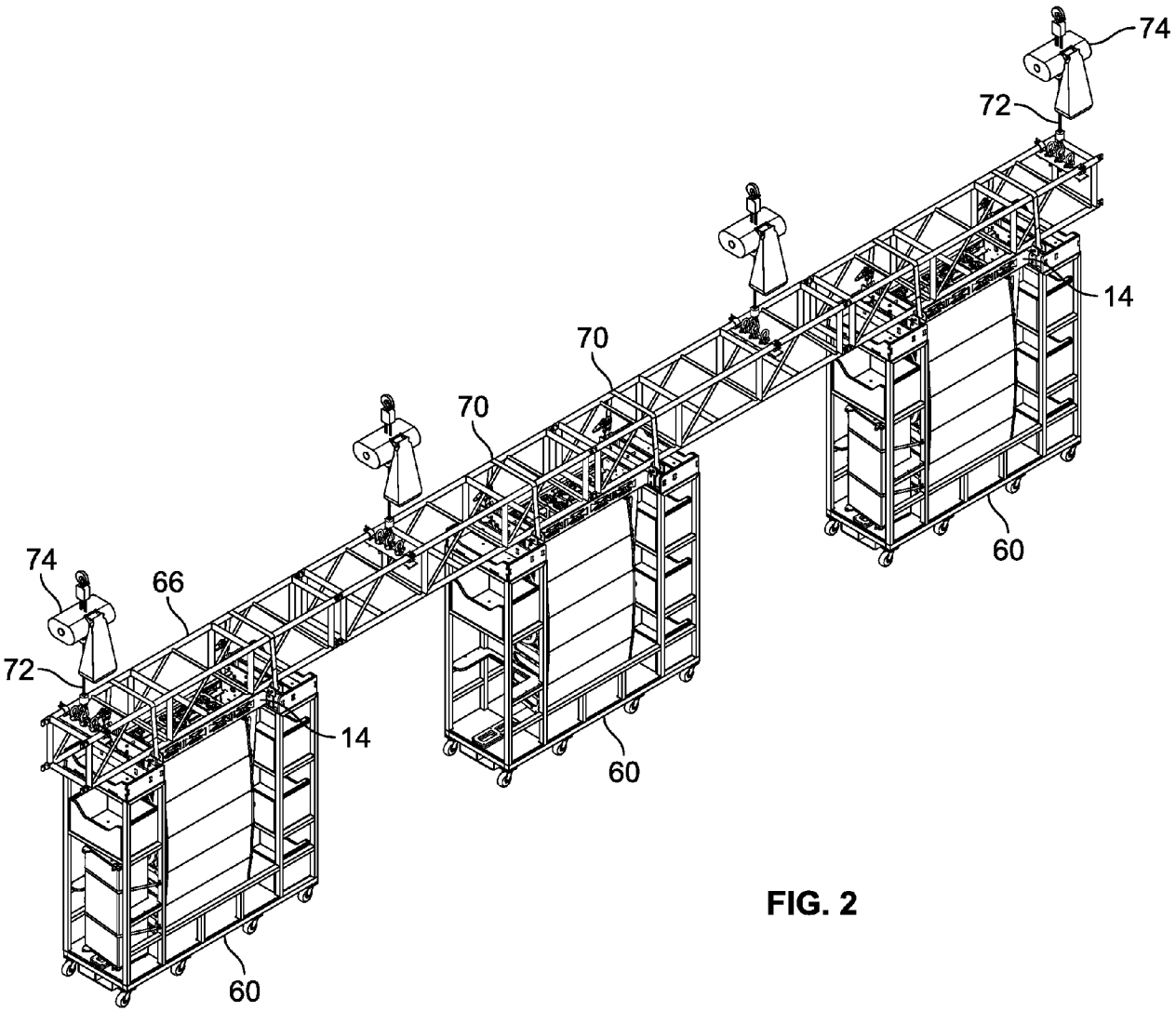
FIG. 2 shows a perspective view of an audio performance system prior to being suspended, according to an exemplary embodiment of the disclosure.

FIG. 2 shows a perspective view of the audio performance system prior to being suspended. That is, one or more shipping containers 60 are positioned beneath a truss 66. Truss 66 is lowered into position over shipping containers 60 by a plurality of lifting devices 74, such as motorized winch assemblies deploying respective cables 72 connected to truss 66. When sufficiently lowered, truss 66 is brought into an abutting contact with engagement features 68 (FIG. 1) formed in first base structure 14. As further shown in FIG. 4, straps 70 secured to opposite ends of first base structure 14 are directed around truss 66 and cinched tightly about the periphery of truss 66, such as by a ratchet device 76.

Figure 3:
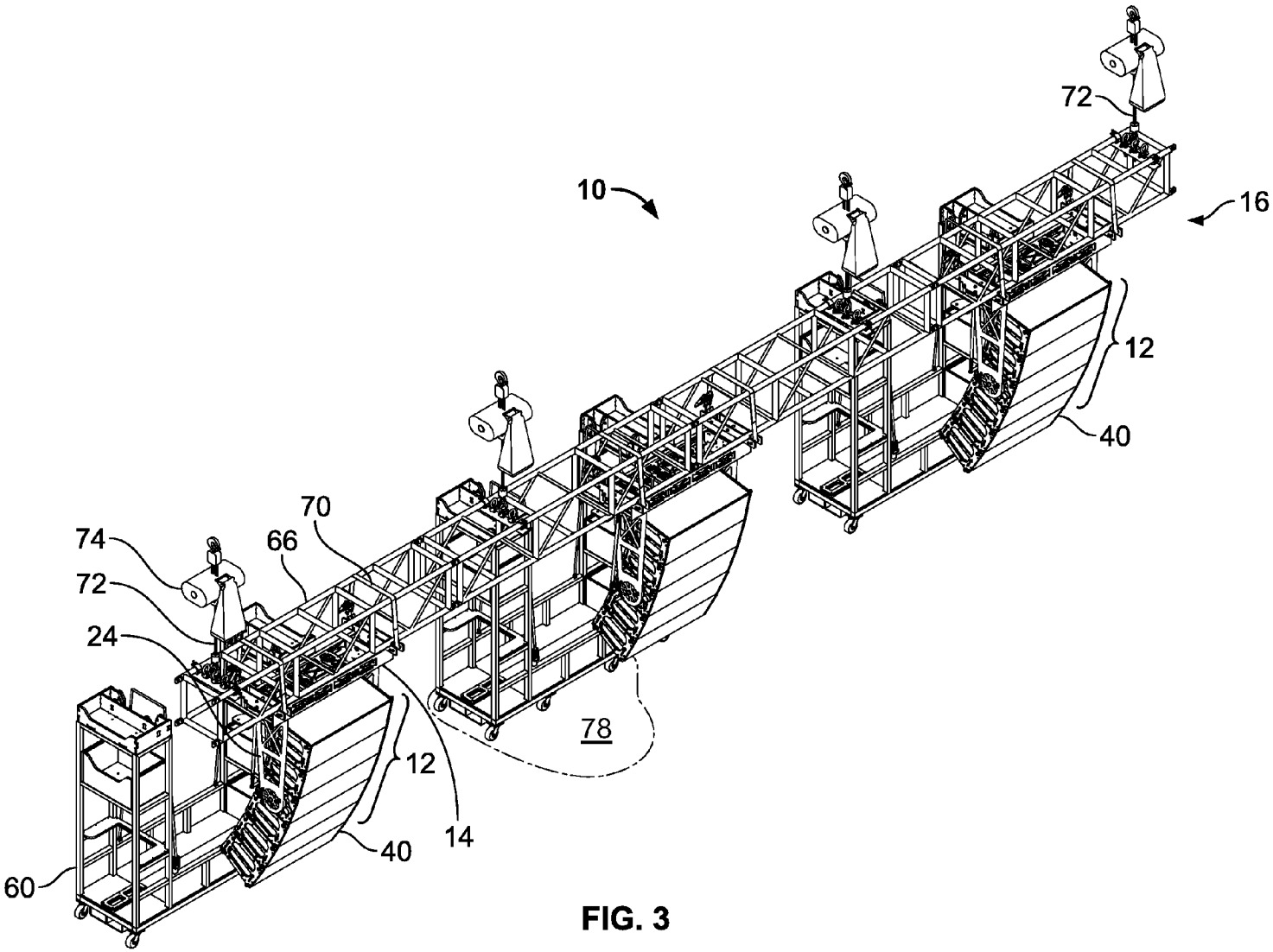
FIG. 3 shows a perspective view of a suspended audio performance system, according to an exemplary embodiment of the disclosure.

As further shown in FIG. 3, once straps 70 have been tightly cinched about truss 66, lifting devices 74 retract respective cables 72 sufficiently to raise truss 66, as well as the plurality of first base structures 14 from their respective shipping containers 60 to a first suspended position 16. Similarly, first electroacoustic devices 12 that are pivotably connected to respective first yokes 24 are also raised to first suspended position 16. Second electroacoustic devices 40 are then removed from shipping containers 60 and secured to respective first electroacoustic devices 12. While first electroacoustic devices 12 and second electroacoustic devices 40 are located at first suspended position 16, which is a short distance from a base surface 78, such as the ground, personnel can collectively manually rotate first and second electroacoustic devices 12, 40 about first axis 26 (FIG. 4) of first yoke 24 to an initial angular position or angular orientation with respect to base surface 78. For purposes of this disclosure, base surface 78 is a reference surface that is substantially horizontal, and is used as the comparative basis for determining an angle, angular position or angular orientation of the electroacoustic devices.

Figure 6:
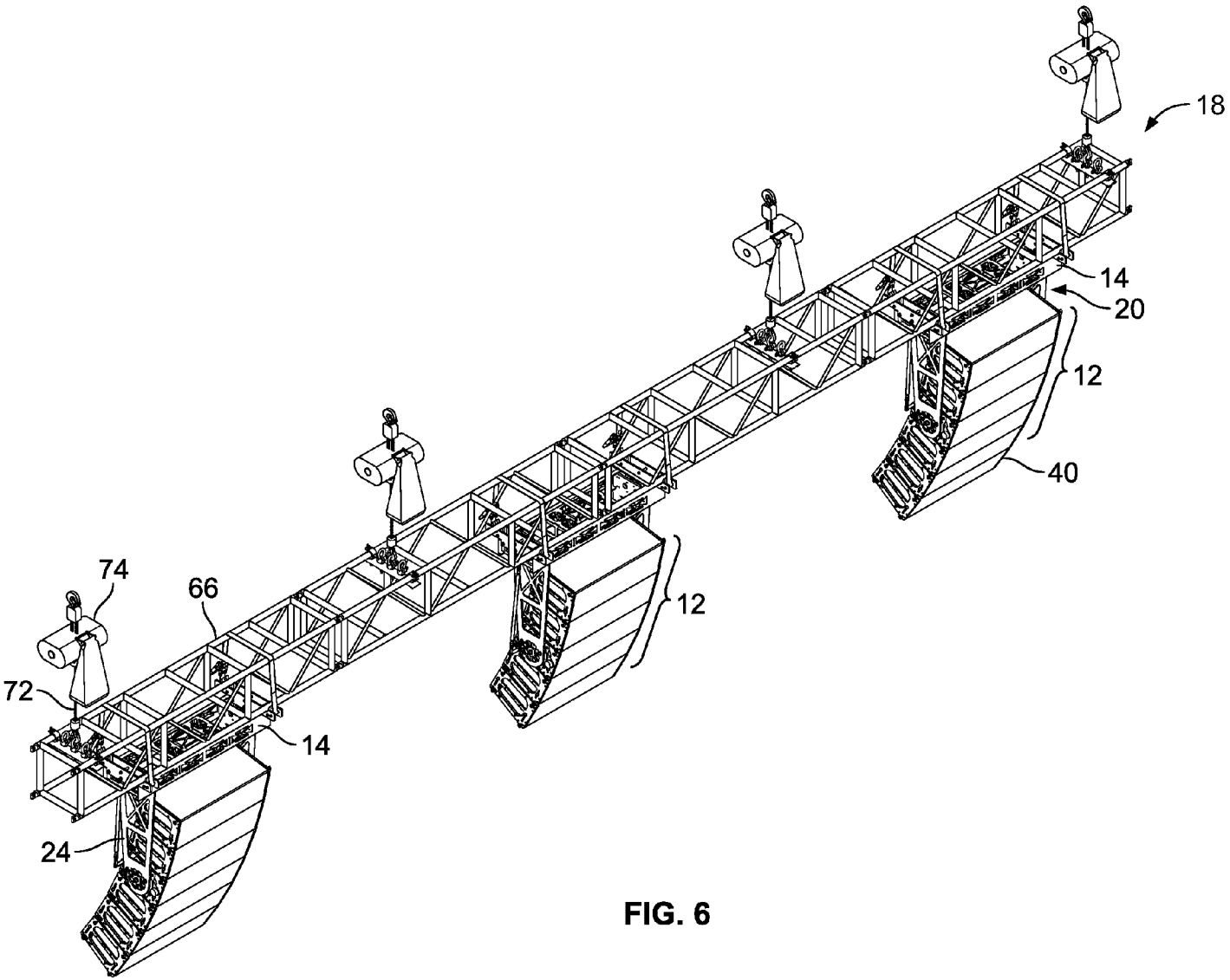
FIG. 6 shows a perspective view of a suspended audio performance system, according to an exemplary embodiment of the disclosure.

As shown in FIG. 6, lifting devices 74 have collectively raised truss 66, first base structures 14, first and second electroacoustic devices 12, 40 from first suspended position 16 (FIG. 3) to a second suspended position 18. For purposes of this disclosure, second suspended position 18 generally corresponds to the highest position the suspended audio performance system is raised above the base surface 78 (FIG. 3) or ground, and operated.

Figure 4:
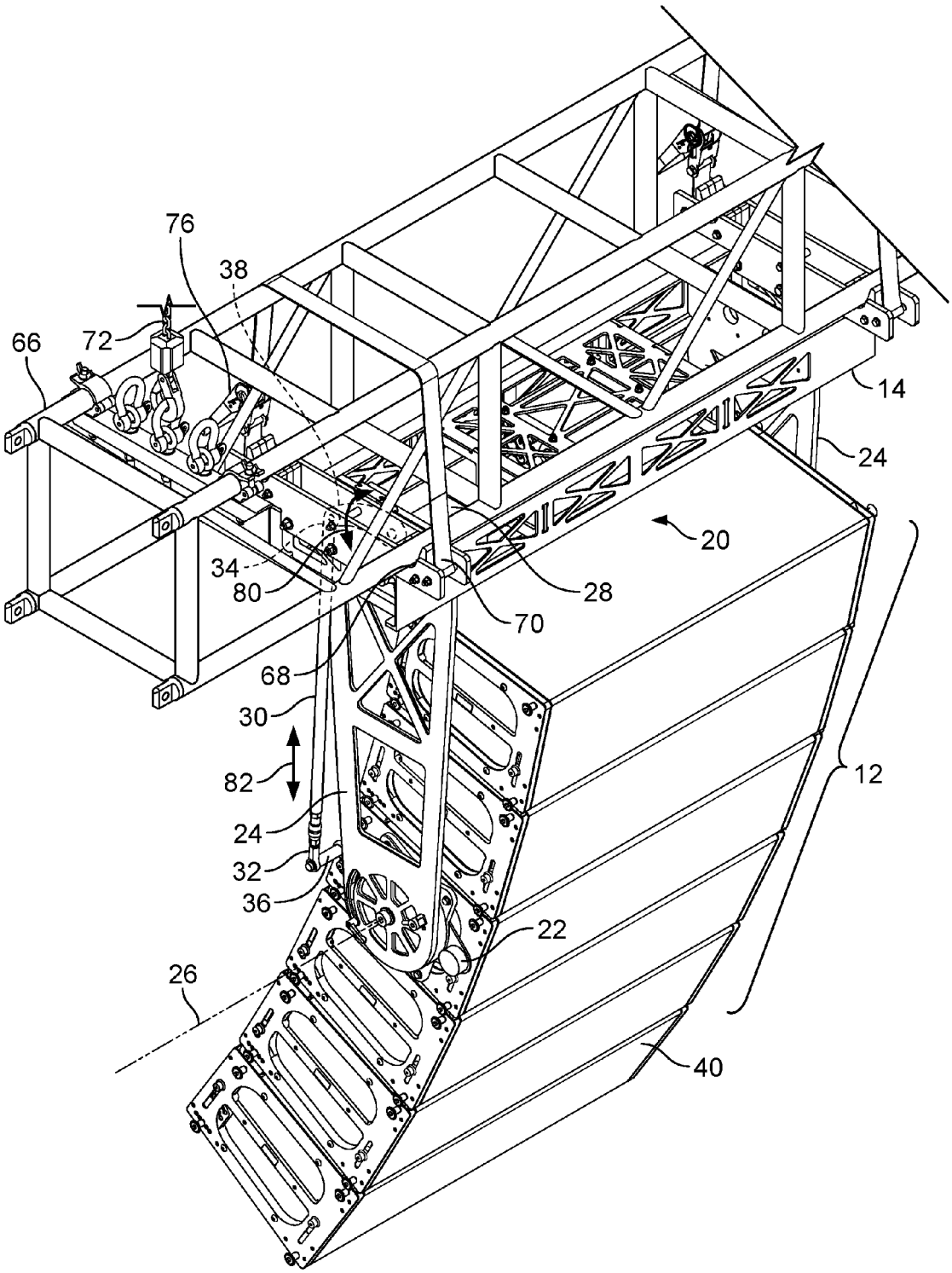
FIG. 4 shows an enlarged, partial perspective view of a portion of a suspended audio performance system, according to an exemplary embodiment of the disclosure.

FIG. 4, which shows an enlarged, partial perspective view of a portion of the suspended audio performance system of FIG. 3, shows an orientation adjustment device 20 associated with first base structure 14. Orientation adjustment device 20 includes a first actuating device 28, such as a rotary actuator for rotatably moving a lever 38 about a shaft of first actuating device 28. Orientation adjustment device 20 further includes a first arm 30 having one end 32 rotatably secured to a first pivot 36 associated with first electroacoustic device 12. An opposite end 34 of first arm 30 is rotatably connected to the end of lever 38 associated with first actuating device 28. In one embodiment, first actuating device 28 is a linear actuator secured to end 34 of first arm 30. In response to a control signal or other input from an operator control source (not shown), first actuating device 28 urges lever 38 into a rotational movement 80, resulting in a generally translational movement 82 of first arm 30. As a result of the generally translational movement 82 of first arm 30, first electroacoustic device 12 and second electroacoustic device 40 are collectively rotated about first axis 26 of first yoke 24, which provides controllable adjustment of the angular orientation of first electroacoustic device 12. In one embodiment, first axis 26 generally corresponds to a center of gravity of first electroacoustic device 12, which reduces the magnitude of forces required to rotate first electroacoustic device 12. In one embodiment, first base structure 14 includes an inclinometer 22 secured to first electroacoustic device 12 for measuring the angular orientation of first electroacoustic device 12. In another embodiment, first electroacoustic device 12 includes an inclinometer 22 for measuring the angular orientation of first electroacoustic device 12. Operator control of the angular orientation of first electroacoustic device 12 may be configured to correspond to a desired angular orientation as measured by inclinometer 22. In the embodiment shown in FIG. 4, controllable adjustment of the angular orientation of first electroacoustic device 12 is achieved. However, since second electroacoustic device 40 is non-movingly secured to first electroacoustic device 12, the angular orientation of second electroacoustic device 40 corresponds to a fixed offset or difference in angular orientation from the angular orientation of first electroacoustic device 12. Stated another way, in the embodiment of FIG. 4, only controllable adjustment of the angular orientation of first electroacoustic device 12 is truly achieved, as the angular orientation of second electroacoustic device 40 is a fixed difference between angular positions of the first and second electroacoustic devices 12, 40.

Figure 5:
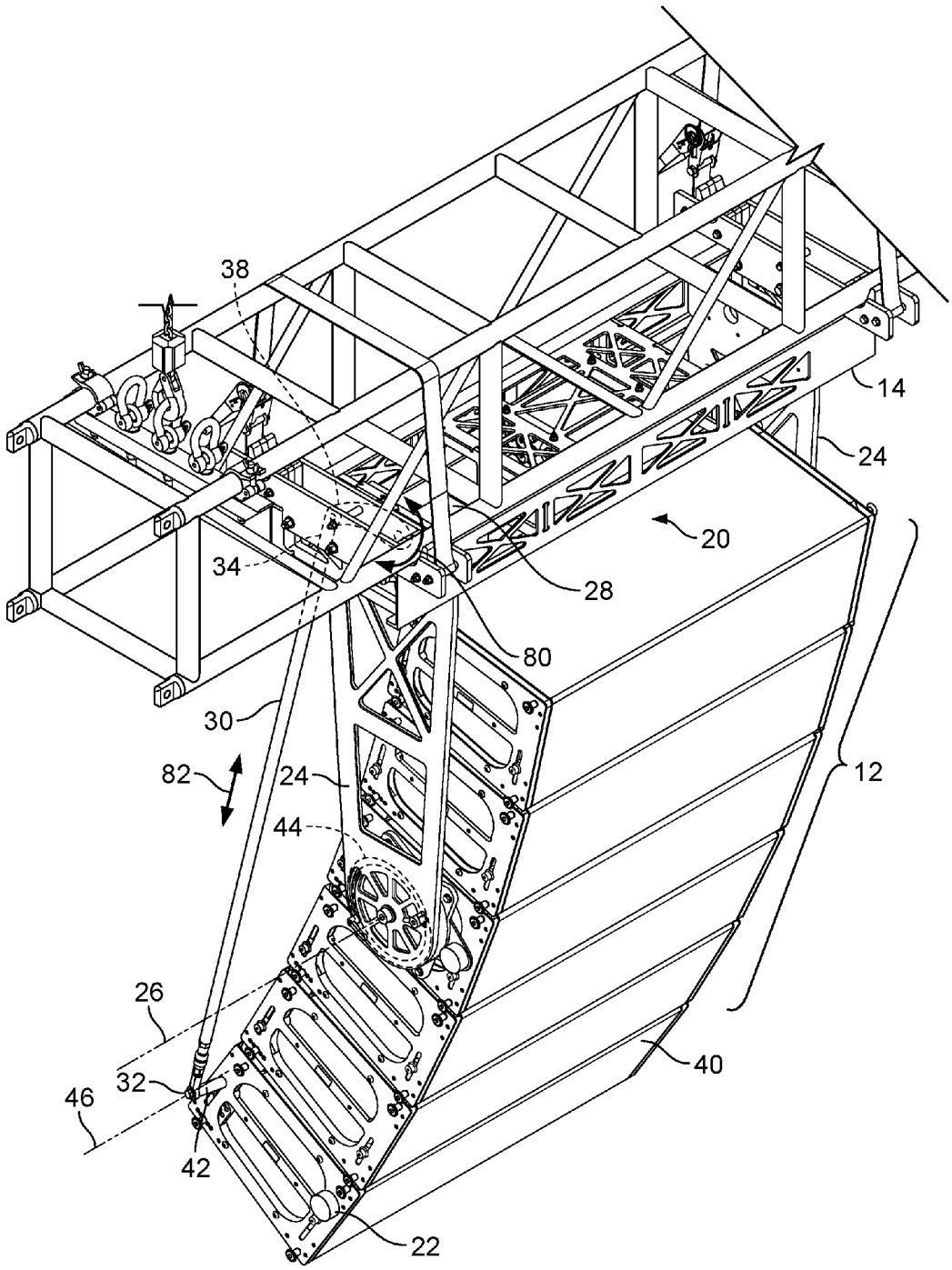
FIG. 5 shows an enlarged, partial perspective view of a portion of a suspended audio performance system, according to an exemplary embodiment of the disclosure.

As shown in FIG. 5, which operates in a similar manner as previously discussed in FIG. 4, end 32 of first arm 30 is rotatably secured to a second pivot 42 associated with second electroacoustic device 40. Opposite end 34 of first arm 30 is rotatably connected to the end of lever 38 of first actuating device 28. In one embodiment, first actuating device 28 is a linear actuator. In response to a control signal or other input from an operator control source (not shown), first actuating device 28 urges lever 38 into a rotational movement 80, resulting in a generally translational movement 82 of first arm 30. As a result of the generally translational movement 82 of first arm 30, first electroacoustic device 12 and second electroacoustic device 40 would otherwise be collectively rotated about first axis 26 of first yoke 24, which provides controllable adjustment of the angular orientation of first electroacoustic device 12. However, in the embodiment as shown in FIG. 5, there exists another pivotable connection between first electroacoustic device 12 and second electroacoustic device 40 about a second axis 46. In addition to an inclinometer 22 being associated with measuring the angular orientation of first electroacoustic device 12, an additional inclinometer 22 is associated with measuring the angular orientation of second electroacoustic device 40. In addition, as further shown in FIG. 5, a rotational control device 44, such as a clutch, is positioned between first yoke 24 and first electroacoustic device 12 about first axis 26. In the embodiment shown in FIG. 5, an operator may achieve control of the angular orientation of first electroacoustic device 12, as well as control of the angular orientation of second electroacoustic device 40. That is, upon the operator achieving a desired angular orientation of first electroacoustic device 12 by selectively manipulating first arm 30 and first actuating device 28 to achieve a desired amount of rotation of first electroacoustic device 12 about first axis 26, such as measured by inclinometer 22, rotational control device 44 can then be activated, thus preventing further rotation of first electroacoustic device 12 about first axis 26. As a result of activation of rotational control device 44, the angular position or angular orientation of first electroacoustic device 12 is fixed in a desired angular position, and therefore, control of the angular orientation of first electroacoustic device 12 is achieved. Further manipulation of first arm 30 and first actuating device 28 results in rotational movement about second axis 46, within the adjustment parameter limits of the interconnections between the first and second actuating devices 12, 40 to achieve control of the angular position or angular orientation of second electroacoustic device 40. It is understood by one skilled in the art that operator manipulation to achieve a desired angular orientation of either of the first electroacoustic device 12 or the second electroacoustic device 40 would be limited by these adjustment parameter limits. Further limitations, such as those corresponding to the operating loading capacities of the components would be incorporated into the operator controls to prevent inadvertent damage to the audio performance system components.

Figure 7:
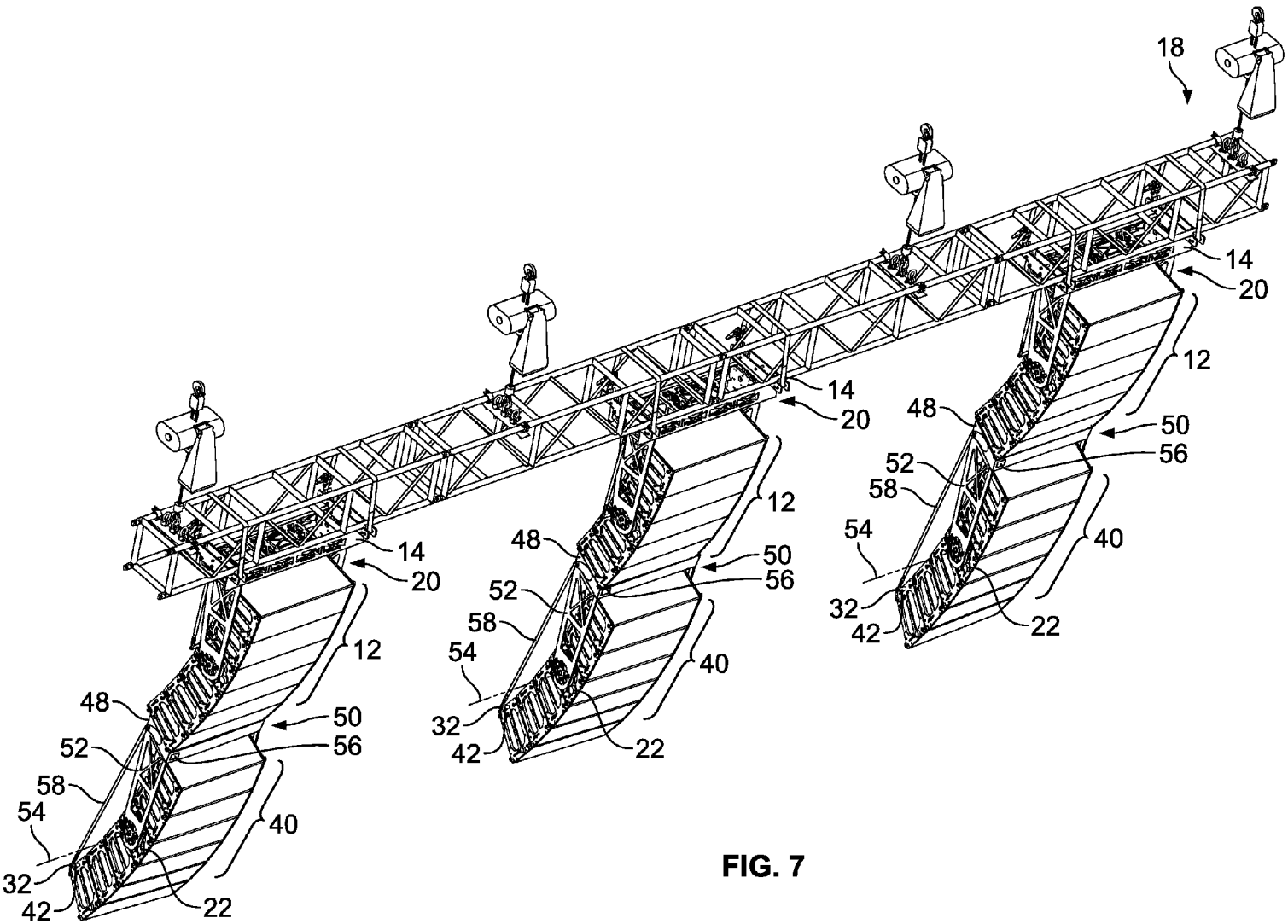
FIG. 7 shows a perspective view of a suspended audio performance system, according to an exemplary embodiment of the disclosure.

As shown in FIG. 7, another embodiment for controlling angular orientation of first electroacoustic device 12 and second electroacoustic device 40 is now discussed. As further shown in FIG. 7, first electroacoustic device 12 is configured similar to that as shown in FIG. 4 for providing controllable angular orientation of first electroacoustic device 12, as previously discussed. Second electroacoustic device 40 includes a second base structure 48 that is secured to first electroacoustic device 12. As shown in FIG. 7, second base structure 48 is configured to be suspended beneath first electroacoustic device 12. Second base structure 48 includes a second yoke 52 that is pivotably secured to second electroacoustic device 40 for rotating second electroacoustic device 40 about a second axis 54. Second base structure 48 has an orientation adjustment device 50 for controllably adjusting the angular orientation of second electroacoustic device 40. In one embodiment, orientation adjustment device 50 includes a second actuating device 56 that operates in a manner similar to first actuating device 28 as previously discussed. Orientation adjustment device 50 further includes a second arm 58 having opposed ends pivotably secured between a second pivot 42 associated with second electroacoustic device 40 and to second actuating device 56 in a manner similar to arm 30 of first actuating device 28. An inclinometer 22 is provided for measuring the angular orientation of second electroacoustic device 40. As a result of second base structure 48 and associated components of orientation adjustment device 50, controllable adjustment of the angular orientation of second electroacoustic device 40 is achieved.

It is to be understood that the disclosure contemplates a third electroacoustic device, or more electroacoustic devices which may be included as a part of the suspended audio performance system.

It is important to note that the construction and arrangement of the present application as shown in the various exemplary embodiments is illustrative only. Only certain features and embodiments of the invention have been shown and described in the application and many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A suspended audio performance system comprising: a first electroacoustic device; and a first base structure secured to the first electroacoustic device, the first base structure configured to be suspended between a first suspended position and a second suspended position; wherein the first base structure includes an orientation adjustment device for controllably adjusting an angular orientation of the first electroacoustic device; wherein the first base structure includes a first yoke having a first axis, the first electroacoustic device pivotably secured to the first yoke for rotational movement of the first electroacoustic device about the first axis; wherein the orientation adjustment device includes a first actuating device and a first arm having opposed ends extending between a first pivot associated with the first electroacoustic device and the first actuating device, actuation of the first actuating device controllably adjusting the angular orientation of the first electroacoustic device about the first axis; wherein the first actuating device is a linear actuator that is a motor having a rotating shaft secured to a lever configured to receive an end of the first arm.

2. The system of claim 1, wherein the first base structure includes an inclinometer secured to the first electroacoustic device for measuring the angular orientation of the first electroacoustic device.

3. The system of claim 1, wherein the first electroacoustic device includes an inclinometer for measuring an angular orientation of the first electroacoustic device.

4. The system of claim 1, wherein the first electroacoustic device is configured to receive a second electroacoustic device.

5. The system of claim 4, wherein the first base structure includes a first arm having opposed ends extending between a second pivot associated with the second electroacoustic device and a first actuating device, actuation of the first actuating device controllably adjusting the angular orientation of at least one of the first electroacoustic device and the second electroacoustic device.

6. The system of claim 5, wherein the orientation adjustment device includes a rotational control device operatively connected to the first axis.

7. A suspended audio performance system comprising: a first electroacoustic device; a second electroacoustic device; a first base structure pivotably secured to the first electroacoustic device, the first base structure configured to be suspended between a first suspended position and a second suspended position; the first base structure including an orientation adjustment device for controllably adjusting an angular orientation of the first electroacoustic device; a second base structure pivotably secured to the second electroacoustic device, the second base structure configured to be secured to the first electroacoustic device, the second base structure configured to be suspended beneath the first electroacoustic device between the first suspended position and the second suspended position; and the second base structure including an orientation adjustment device for controllably adjusting an angular orientation of the second electroacoustic device; wherein the first base structure includes a first yoke including a first axis, the first electroacoustic device pivotably secured to the first yoke for rotational movement of the first electroacoustic device about the first axis; wherein the orientation adjustment device includes a first actuating device and a first arm having opposed ends extending between a first pivot associated with the first electroacoustic device and the first actuating device, actuation of the first actuating device controllably adjusting the angular orientation of the first electroacoustic device about the first axis; wherein the first actuating device is a linear actuator that is a motor having a rotating shaft secured to a lever configured to receive an end of the first arm.

8. The system of claim 7, wherein the first base structure includes an inclinometer secured to the first electroacoustic device for measuring the angular orientation of the first electroacoustic device.

9. The system of claim 7, wherein the first electroacoustic device includes an inclinometer for measuring an angular orientation of the first electroacoustic device.

10. The system of claim 7, wherein the second base structure includes an inclinometer secured to the second electroacoustic device for measuring the angular orientation of the second electroacoustic device.

11. The system of claim 7, wherein the second electroacoustic device includes an inclinometer for measuring an angular orientation of the second electroacoustic device.

12. The system of claim 7, wherein the second base structure includes a second yoke including a second axis, the second electroacoustic device pivotably secured to the second yoke for rotational movement of the second electroacoustic device about the second axis.

13. The system of claim 12, wherein the orientation adjustment device of the first base structure includes a first actuating device and a first arm having opposed ends extending between a first pivot associated with the first electroacoustic device and the first actuating device, actuation of the first actuating device controllably adjusting the angular orientation of the first electroacoustic device about the first axis, and the orientation adjustment device of the second base structure includes a second actuating device and a second arm having opposed ends extending between a second pivot associated with the second electroacoustic device and the second actuating device, actuation of the second actuating device controllably adjusting the angular orientation of the second electroacoustic device about the second axis.

14. A method for angular orientation control of a suspended audio performance system comprising: providing a first electroacoustic device and a first base structure pivotably secured to the first electroacoustic device, the first base structure configured to be suspended between a first suspended position and a second suspended position~wherein the first base structure includes a first yoke including a first axis, the first electroacoustic device pivotably secured to the first yoke for rotational movement of the first electroacoustic device about the first axis; controllably adjusting an angular orientation of the first electroacoustic device about the first axis between the first suspended position and the second suspended position; wherein the orientation adjustment device includes a first actuating device and a first arm having opposed ends extending between a first pivot associated with the first electroacoustic device and the first actuating device, actuation of the first actuating device controllably adjusting the angular orientation of the first electroacoustic device about the first axis; wherein the first actuating device is a linear actuator that is a motor having a rotating shaft secured to a lever configured to receive an end of the first arm.

15. The method of claim 14, further providing a second electroacoustic device and a second base structure pivotably secured to the second electroacoustic device, the second base structure configured to be secured to the first electroacoustic device, the second base structure configured to be suspended beneath the first electroacoustic device between the first suspended position and the second suspended position; and controllably adjusting an angular orientation of the second electroacoustic device between the first suspended position and the second suspended position.

* * * * *